US008388359B1

(12) United States Patent
Mahoney

(10) Patent No.: US 8,388,359 B1
(45) Date of Patent: Mar. 5, 2013

(54) IGNITION TERMINAL APPARATUS AND METHOD FOR FORMING A TEMPERATURE-RESISTANT INSULATING HOUSING

(76) Inventor: Errol D. Mahoney, Jupiter, FL (US)

( * ) Notice: Subject to any disclaimer, the term of this patent is extended or adjusted under 35 U.S.C. 154(b) by 44 days.

(21) Appl. No.: 12/800,407

(22) Filed: May 14, 2010

(51) Int. Cl.
*H01R 13/44* (2006.01)

(52) U.S. Cl. ..... 439/125

(58) Field of Classification Search ..... 439/125
See application file for complete search history.

(56) References Cited

U.S. PATENT DOCUMENTS 4,145,106 A * 3/1979 Livingston ..... 439/126
4,199,210 A * 4/1980 Trott ..... 439/201
4,350,408 A * 9/1982 Hays ..... 439/603
5,281,767 A * 1/1994 West et al. ..... 174/142
5,720,264 A * 2/1998 Oosuka et al. ..... 123/634
6,206,709 B1 * 3/2001 Uchiyama ..... 439/125
6,273,733 B1 * 8/2001 Uchiyama ..... 439/125
6,340,303 B2 * 1/2002 Hamada et al. ..... 439/127
6,668,810 B1 * 12/2003 St. John et al. ..... 123/634
7,442,081 B2 * 10/2008 Burke et al. ..... 439/589
7,455,536 B2 * 11/2008 Virchow ..... 439/125

* cited by examiner

*Primary Examiner* — Truc Nguyen
(74) *Attorney, Agent, or Firm* — Norman Friedland; Ronald V. Davidge

(57) ABSTRACT

An ignition terminal built for connection to a spark plug or igniter includes an insulating housing composed of polyphenylene sulfide extending outward from conductive structures within the ignition terminal. The ignition terminal may be an extender that is used to move a point of connection of an ignition cable to the spark plug or igniter outward, so that such a connection can be easily made, or the ignition terminal may be at an end of the ignition cable itself that is directly connected to the spark plug or igniter.

9 Claims, 2 Drawing Sheets

IGNITION TERMINAL APPARATUS AND METHOD FOR FORMING A TEMPERATURE-RESISTANT INSULATING HOUSING

RELATED APPLICATIONS

Not Applicable

FEDERALLY SPONSORED RESEARCH OR DEVELOPMENT

Not Applicable

BACKGROUND OF THE INVENTION

1. Field of the Invention

This invention relates to a terminal within an ignition circuit of an internal combustion engine and, more specifically, to such a connector in the form of an extender or an end of an ignition cable having a temperature-resistant insulating housing.

2. Summary of the Background Information

A reciprocating internal combustion engine that is not a Diesel engine includes an ignition system providing electrical current at a very high voltage to a number of spark plugs in order to ignite a mixture of fuel and air within a number of cylinders, with the electrical current being generated within a coil and delivered to the spark plugs as pulses synchronized with the rotation of a crankshaft within the engine. An internal combustion turbine engine typically includes an ignition system providing a high-voltage electrical current to one or more igniter plugs, with the electrical power being applied only to start the engine, and later, if necessary, to restart the engine in the event of a flame-out. In either case, electrical current is supplied to each spark plug or to each igniter through an ignition cable extending from a power source. Because of voltages present within the ignition cable, conductive structures within the cable, including both a wire portion and connection hardware, must be insulated to prevent arcing or leakage currents to various adjacent conductive surfaces. Because of the location of the cable adjacent to the engine, materials used for insulation must withstand high temperatures and chemicals resulting from the combustion of fuel as well as high voltages.

Ignition cables include conductive connection structures that are required to make electrical and mechanical connections at each end. Conventionally, these structures are covered with insulating housings composed of PTFE (polytetrafluoroethylene), ceramic material, silicone rubber, and PPA (polyphthalamide). These conventional materials all have disadvantages. For example, PTFE is expensive due to the cost of the material and due to the machining operations that may be required to form suitable insulating housings, while at temperatures above 450 deg F. PTFE is known to become gelatinous, causing insulating housings to deform, leading to mechanical and dielectric failures. Insulating housings composed of PPA, which has a maximum service temperature of only 329 deg F., used with engines burning natural gas have been known to fail due to the effects of high operating temperatures. Silicone rubber is not compatible with steam or petroleum based materials and is susceptible to heat embrittlement.

FIG. 1 is a longitudinal cross-sectional view of a conventional extender 10, which is provided to bring the electrical connection to a spark plug, within a spark plug hole in the cylinder head of a reciprocating engine, outward, to a point at which an ignition cable can be easily installed and removed. The conventional extender 10 includes a cylindrical distal portion 12 that extends within the spark plug hole of the engine (not shown) around the spark plug (additionally not shown) held within a cavity 13 with a spring contact 14 engaging the terminal of the spark plug. The spring contact 14 is connected to an electrode 16 extending to a threaded portion 18 at a distal end 20 of the extender 10. Insulation is provided by an outer ceramic insulator 26 extending around the spark plug (not shown) and the spring contact 14, an inner ceramic insulator 21 extending along the electrode 16, a distal PTFE insulator 22 extending over the inner distal ceramic insulator 21 and over a portion of the proximal ceramic insulator 20, a proximal PTFE insulator 24 extending over another portion of the proximal ceramic insulator 20, and an outer distal ceramic insulator 26 extending over the distal PTFE insulator 22. These insulating components 28 are not overmolded, but are instead formed and machined to fit together as shown.

The patent literature includes descriptions, which do not apply to the device shown in FIG. 1, of two-component insulating systems in which the outer component is formed from a material composing PPS (polyphenylene sulfide). In one example, a housing for an ignition coil assembly is molded of a material selected from a group including PPS, to which a reinforcing filler is added, with the housing forming the outer layer of a two-component insulation system. The inner layer is formed by an insulating oil, in which the ignition coil is dipped to be held within a groove inside the housing. In another example, an insulated wire includes a conductor and at least two insulating layers provided on the outer periphery of the conductor. The inner insulating layer is composed of a polyolefin compound, while the outer insulating layer is composed of a single substance or a blend of substances taken from a group including PPS.

SUMMARY OF THE INVENTION

In accordance with one aspect of the invention, an ignition terminal is provided, with the ignition terminal comprising an insulating housing composed of polyphenylene sulfide, a contact structure, and an elongated conductor attached to the contact structure. The insulating housing has a distal end and a proximal end. The contact structure includes a spring contact outwardly exposed at the distal end. The elongated conductor extends along the insulating housing and outwardly from the proximal end of the insulating housing.

The insulating housing may form a single component contacting the contact structure or the elongated conductor and extending outwardly therefrom. The insulating housing may extend around the spring contact, forming a cavity in which the spring contact is held, being outwardly exposed through an opening in the distal end of the insulating housing, with the elongated conductor being coaxial with the cavity or perpendicular to the cavity.

In a first embodiment of the invention, the ignition terminal is configured as an extender, which is provided to bring the electrical connection to a spark plug within a spark plug hole in the cylinder head of a reciprocating engine outward, to a point at which a separate ignition cable can be easily installed and removed. Within the ignition terminal, the elongated conductor comprises an electrode having a threaded end outwardly disposed from the proximal end of the insulating housing for the attachment of a separate ignition cable. The elongated conductor may additionally include an enlarged portion within the insulating housing, which is formed by molding over a central portion of the elongated conductor, including the enlarged portion.

In a second embodiment of the invention, the ignition terminal is formed at an end of an ignition cable, which can be installed and removed at a terminal of a spark plug or igniter, with an insulated wire extending outward from the proximal end of the insulating housing.

In accordance with another aspect of the invention, a method is provided for forming an ignition terminal The method includes: placing a conductive structure within an open mold having a cavity shaped to form an external surface of the ignition terminal; closing the mold with each end of the conductive structure supported within the mold; filling the mold cavity with liquefied polyphenylene sulfide; solidifying the liquid polyphenylene sulfide within the mold cavity; opening the mold; and removing the conductive structure from the mold cavity with a polyphenylene sulfide insulating housing formed around the conductive structure.

BRIEF DESCRIPTION OF THE FIGURES

These and other aspects of the invention will be made apparent by reading the following specification in conjunction with the drawings, in which.

DETAILED DESCRIPTION OF THE INVENTION

Figure 2:
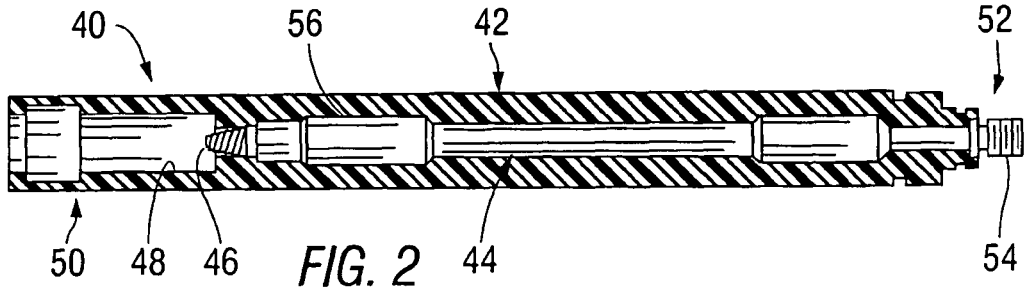
FIG. 2 is a longitudinal cross-sectional view of an ignition terminal forming an extender built in accordance with a first embodiment of the invention.
Figure 3:
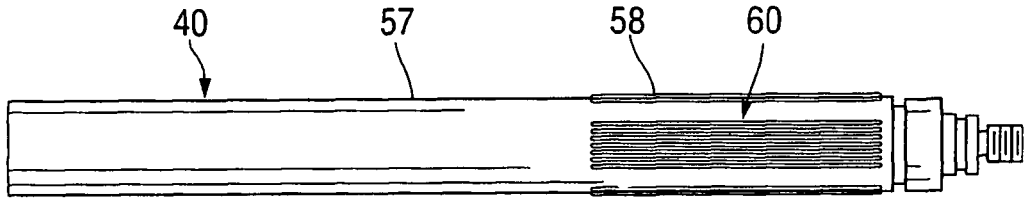
FIG. 3 is a lateral elevation of the ignition terminal of FIG. 2.

An ignition terminal built in accordance with a first embodiment of the invention to form an extender, bringing the electrical connection to a spark plug held within a spark plug hole in the cylinder head of a reciprocating engine, outward, to a point at which a separate ignition cable can be easily installed and removed, will first be discussed, with reference being made to FIGS. 2 and 3. FIG. 2 is a longitudinal cross-sectional elevation of this extender 40, while FIG. 3 is a lateral elevation thereof. An insulating housing 42, composed of PPS (polyphenylene sulfide), which extends around an elongated conductor formed as an electrode 44 and a spring contact 46 attached to the electrode 44, includes a cavity 48 provided for holding a spark plug (not shown) at a distal section 50 of the extender 40. The electrode 44 extends outward from a proximal end 52 of the extender, with a threaded end 54 of the electrode 44 forming a convenient place for the attachment of an ignition cable or coil (not shown) to provided electrical current to the spark plug through the spring contact 46. Preferably, the insulating housing 42 is formed by injection molding a PPS resin over an assembly comprising the electrode 44 and the spring contact 46, with an insert extending into the mold cavity filled with the resin forming the cavity 48 and holding the spring contact 46 within the mold cavity during the molding process. After the molding process, enlarged sections 56 of the electrode 44 holding the electrode 44 in place within the insulating housing 42. External features of the extender 40, include the generally cylindrical outer surface 57 of the insulating housing 42 with a plurality of ribs 58 providing surfaces 60 suitable for hand tightening a threaded connection to the extender 40.

Figure 1:
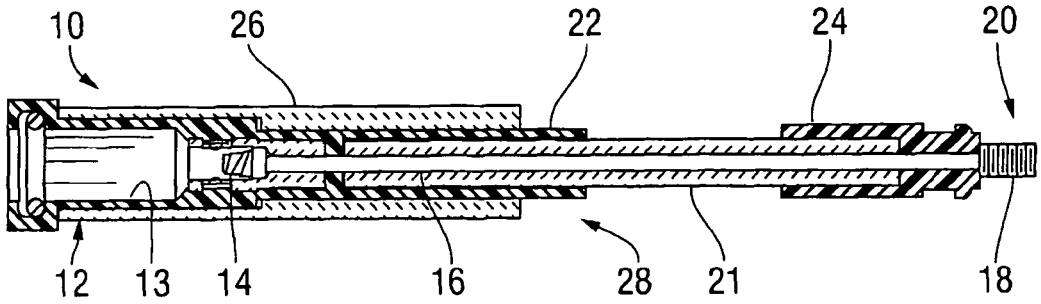
FIG. 1 PRIOR ART
FIG. 1 is a longitudinal cross-sectional elevation of a conventional extender for use in an ignition system.

In the extender 40, the combination of dielectric, mechanical, and heat-resistant properties of the insulating housing 42, composed of PPS, provide for the use of a single over-molded part to replace four separate insulating housings 21, 22, 24, 26 in the prior-art extender 10, which has been discussed above in reference to FIG. 1. This simplification results in a significant reduction in the manufacturing cost of an extender.

Figure 4:
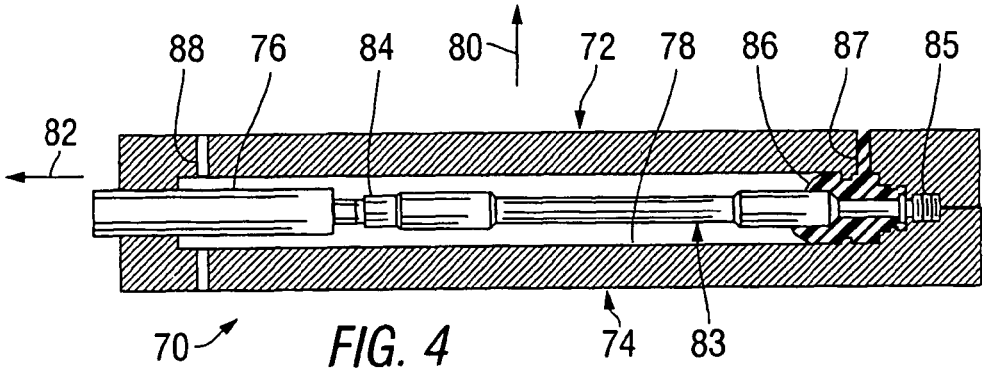
FIG. 4 is a longitudinal cross-sectional view of a mold for forming an insulating housing within the ignition terminal of FIG. 2.

FIG. 4 is a longitudinal cross-sectional view of a mold 70 used in an exemplary injection molding process for forming the insulating housing 42. The mold 70 includes an upper section 72, a lower section 74, and an insert 76, with a mold cavity 78, disposed between the die sections 72, 74, being shaped to form the external surfaces of the extender 40 as shown in FIG. 3. The insert 76 is shaped to form the cavity 48, shown in FIG. 1, within the insulating housing 42. The mold 70 is opened by moving the upper section 72 upward, in the direction of arrow 80, and by moving the insert 76 outward, in the direction of arrow 82. The mold 70 is closed by moving the upper section downward, opposite the direction of arrow 80, and by moving the insert inward, opposite the direction of arrow 82.

The process for forming the insulating housing 42 begins with placing a conductive structure 83 within the mold cavity 78 with the mold 70 being held open. Then, the mold 70 is closed with a distal end 84 of the conductive structure 83 and a proximal end 85 thereof both being held within the mold 70. Next, mold cavity 78 is filled by injecting a liquefied PPS resin 86, held at a temperature sufficient to maintain a molten state, through at least one injection hole 87 into the mold cavity 78, with gases and excess liquefied PPS resin 86 escaping from the mold cavity 78 through vent holes 88. The liquefied PPS resin 86 filling the mold cavity 78 is then allowed to cool and solidify within the mold cavity 78. Finally, the mold 70 is opened, and the conductive structure 83 is removed therefrom, with the insulating housing 42 having been formed around the conductive structure 83.

For example, the conductive structure 83 includes the electrode 44, described above in reference to FIG. 2, having at least one enlarged section 56 with threads on the proximal end 85. The distal end 84 of the conductive structure 83 may include the spring contact 46, which is then engaged by a mounting surface (not shown) within the insert 46. Alternately, the insert 46 may engage the distal end of the electrode 44, with the spring contact 46 being attached to the electrode 44 after the conductive structure 83 is removed from the mold 70.

A number of ignition terminals, each built in accordance with a second embodiment of the invention to form an end of an ignition cable to be connected to a spark plug or an igniter will now be discussed with reference being made to FIGS. 5-8.

Figure 5:
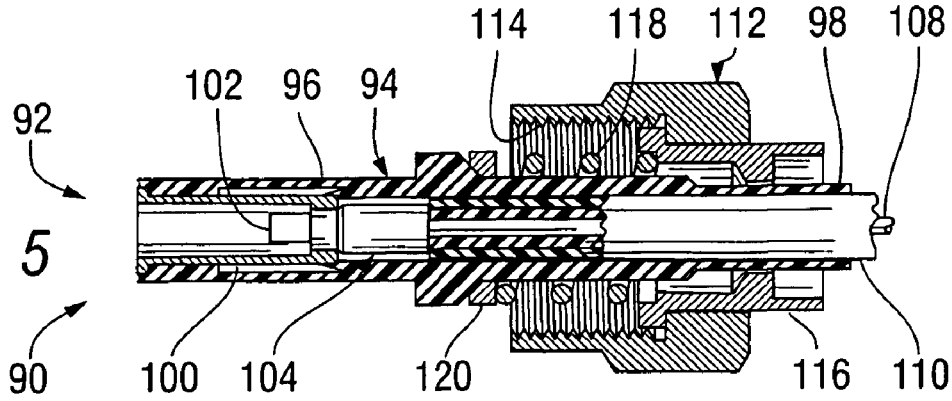
FIG. 5 is a fragmentary longitudinal cross-sectional view of a first ignition cable having an ignition terminal built in accordance with a second embodiment of the invention.

FIG. 5 is a fragmentary longitudinal cross-sectional view of an ignition cable 90 having an ignition terminal 92 including an insulating housing 94, composed of PPS, with a distal portion 96 that replaces a first insulator in a conventional version of the ignition cable 90, and with a proximal portion 98 that replaces a second insulator. These first and second insulators in the conventional version may each be formed of a ceramic material or a thermoplastic resin. The distal portion 96 of the insulating housing 94 extends over a retainer 100, which may be conductive or nonconductive and which is disposed over a spring contact 102 that is provided for engaging the terminal of a spark plug (not shown). The spring contact 102 forms part of a contact assembly 104 that is connected to an elongated conductor 108 within an insulated wire 110 extending away from the terminal 92. The terminal 92 is held in place on the spark plug (not shown) by a nut 112 having a threaded surface 114 engaging a threaded cylinder (not shown) extending outward around the spark plug. The nut 112 is rotatably mounted on a ferrule 116 that applies a force to the insulating housing 84 through a compression spring 118 and a washer 120.

Figure 6:
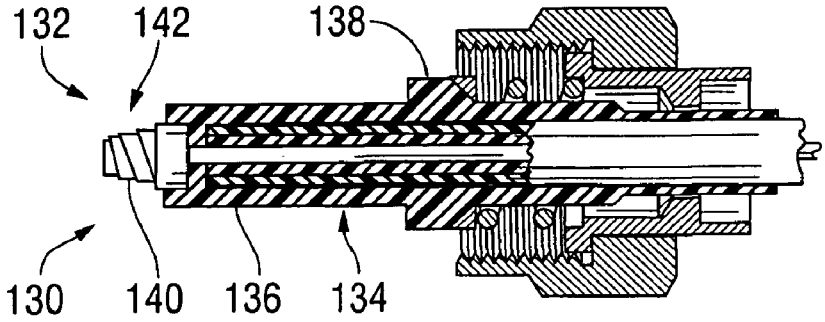
FIG. 6 is a fragmentary longitudinal cross-sectional view of a second ignition cable having an ignition terminal built in accordance with the second embodiment of the invention.

FIG. 6 is a fragmentary longitudinal cross-sectional view of an ignition cable 130 having an ignition terminal 132 including an insulating housing 134, composed of PPS, with a distal portion 136 that replaces a first insulator in a conventional version of the ignition cable 130, and with a proximal portion 138 that replaces a second insulator in the conventional version of the ignition cable 130. Again, the first and second insulators in the conventional version may be composed of a ceramic material or of a thermoplastic resin. The ignition terminal 132 includes a spring contact 140 that is outwardly exposed at a distal end 142 of the terminal 132, with various other features being as described above in reference to FIG. 5.

Figure 7:
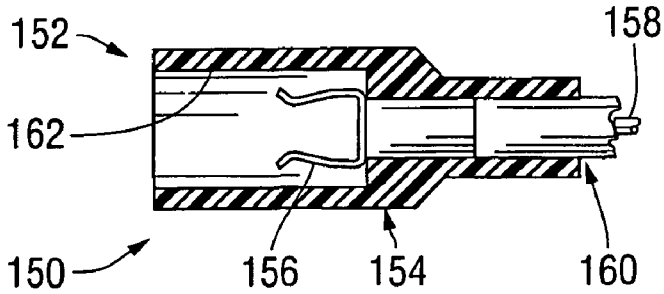
FIG. 7 is a fragmentary longitudinal cross-sectional view of a third ignition cable having an ignition terminal built in accordance with the second embodiment of the invention.

FIG. 7 is a fragmentary longitudinal cross-sectional view of an ignition cable 150 having an ignition terminal 152 including an insulating housing 154, composed of PPS, replacing a PTFE insulator in a conventional version of the ignition cable 150. A spring contact 156, configured for attachment to a spark plug terminal, is attached to an elongated conductor 158 within an insulated wire 160. The insulating housing 154 includes a cylindrical cavity 162 surrounding the spring contact 156, with the cylindrical cavity 162 being coaxial with the insulated wire 160.

Figure 8:
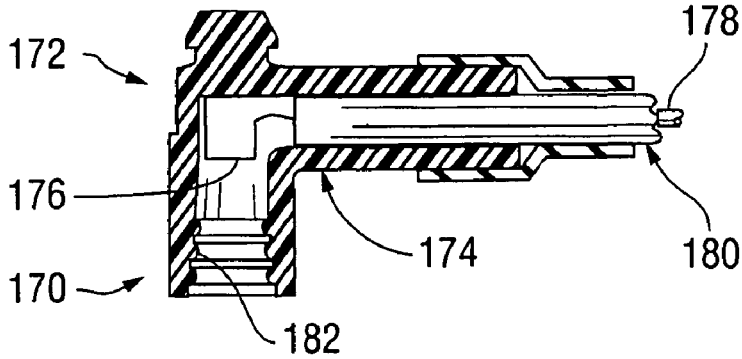
FIG. 8 is a fragmentary longitudinal cross-sectional view of a fourth ignition cable having an ignition terminal built in accordance with a second embodiment of the invention.

FIG. 8 is a fragmentary longitudinal cross-sectional view of an ignition cable 170 having an ignition terminal 172 including an insulating housing 174, composed of PPS, replacing a silicone rubber insulator in a conventional version of the ignition cable 170. A spring contact 176, configured for attachment to a spark plug terminal, is attached to an elongated conductor 178 within an insulated wire 180. The insulating housing 174 includes a cylindrical cavity 182 surrounding the spring contact 176, with the cylindrical cavity 182 being perpendicular to the insulated wire 180.

In each of the ignition terminals described above in reference to FIGS. 2, 3, and 5-8 has advantages achieved by using PPS instead of the materials and combinations of materials used in prior art devices. For example, while PTFE is expensive due to the cost of the material and due to the machining operations that may be required to form suitable insulating housings, insulating housings formed as described above using PPS are relatively inexpensive and durable. While at temperatures above 450 deg F. PTFE is known to become gelatinous, causing insulating housings to deform, leading to mechanical and dielectric failures, PPS maintains its shape without a loss in dielectric performance at temperatures as high as 0.500 deg F.

While insulating housings composed of PPA, which has a maximum service temperature of only 329 deg F., used with engines burning natural gas have been known to fail due to the effects of high operating temperatures, insulating housing composed of PPS have been shown to be particularly suitable for such use. While silicone rubber is not compatible with steam or petroleum based materials and is susceptible to heat embrittlement. PPS is compatible with these materials and can be used as service temperatures as high as 500 deg F. In such use, PPS has been found to have surprisingly good dielectric properties.

Significant cost savings are achieved through the use of PPS materials in place of other insulating substances, particularly when a single PPS insulating housing is used in place of two or more insulators composed of different materials, including when a PPS insulating housing is used to replace a PPS cover over another insulating material, as described in the prior art.

While the invention has been described in terms of preferred embodiments with some degree of particularity, it is understood that this description has been given only by way of example, and that many changes can be made without departing from the spirit and scope of the invention, as defined in the appended claims.

What is claimed is:

1. An ignition terminal comprising:

an insulating housing composed of polyphenylene sulfide, formed as an integral part having a distal end and a proximal end;

a conductive structure comprising a contact structure including a spring contact outwardly exposed at the distal end of the insulating housing; and an elongated conductor attached to the contact structure, wherein the elongated conductor extends along the insulating housing and outwardly from the proximal end of the insulating housing, wherein the insulating housing extends outwardly from the conductive structure, and wherein the insulating housing contacts the conductive structure.

2. The ignition terminal of claim 1, wherein the elongated conductor comprises an electrode having a threaded end outwardly disposed from the proximal end of the insulating housing.

3. The ignition terminal of claim 2, wherein the elongated conductor additionally comprises an enlarged portion within the insulating housing, and the insulating housing is formed by molding over a central portion of the elongated conductor, including the enlarged portion so that the material of the insulating housing surrounds the enlarged portion.

4. The ignition terminal of claim 2, wherein the insulating housing extends around the spring contact, forming a cavity in which the spring contact is held, and the spring contact is outwardly exposed through an opening in the distal end of the insulating housing.

5. The ignition terminal of claim 1, wherein the elongated conductor is disposed within an insulated wire extending outward from the proximal end of the insulating housing.

6. The ignition terminal of claim 5, wherein the insulating housing extends around the spring contact, forming a cavity in which the spring contact is held, and the spring contact is outwardly exposed through an opening in the distal end of the insulating housing.

7. The ignition terminal of claim 6, wherein the elongated contact structure is coaxial with the cavity in which the spring contact is held.

8. The ignition terminal of claim 6, wherein the elongated contact structure is perpendicular to the cavity in which the spring contact is held.

9. The ignition terminal of claim 1, wherein the insulating housing extends around the spring contact, forming a cavity in which the spring contact is held, and the spring contact is outwardly exposed through an opening in the distal end of the insulating housing.

* * * * *